United States Patent [19]

Li et al.

[11] Patent Number: 4,930,198

[45] **Date of Patent: * Jun. 5, 1990**

[54] APPARATUS FOR TEXTURING CONTINUOUS YARN

[75] Inventors: Hsin L. Li, Parsippany; Hendrikus J. Oswald, Morristown, both of N.J.

[73] Assignee: Allied-Signal Inc., Morris Township, Morris County, N.J.

[ * ] Notice: The portion of the term of this patent subsequent to Aug. 23, 2005 has been disclaimed.

[21] Appl. No.: 200,483

[22] Filed: May 31, 1988

Related U.S. Application Data

[60] Division of Ser. No. 594,958, Apr. 2, 1984, Pat. No. 4,765,042, which is a continuation of Ser. No. 357,499, Mar. 12, 1982, abandoned.

[51] Int. Cl.[5] ..... D02G 1/12; D02G 1/16

[52] U.S. Cl. ..... 28/257

[58] Field of Search ..... 28/250, 251, 254, 256, 28/257, 263, 264, 267, 272, 283; 19/299

[56] References Cited

U.S. PATENT DOCUMENTS

| | | | |
|---|---|---|---|
| 3,073,000 | 1/1963 | Gonsalves et al. | 28/272 X |
| 3,739,053 | 6/1973 | Yazawa | 28/257 X |
| 3,802,980 | 4/1974 | Harmon | 28/283 X |
| 3,887,972 | 6/1975 | Bauch | 28/257 |
| 3,896,529 | 7/1975 | Stanley | 28/221 X |
| 4,019,228 | 4/1977 | Ozawa et al. | 28/257 X |
| 4,024,611 | 5/1977 | Li et al. | 28/257 |
| 4,157,604 | 6/1979 | Oswald et al. | 28/256 X |
| 4,462,143 | 7/1984 | Oswald et al. | 28/257 |
| 4,467,507 | 8/1984 | Oswald et al. | 28/257 |
| 4,765,042 | 8/1988 | Li et al. | 28/257 |

FOREIGN PATENT DOCUMENTS

| | | | |
|---|---|---|---|
| 45-31268 | 10/1970 | Japan | 28/257 |
| 51-2533 | 1/1976 | Japan | 28/257 |

*Primary Examiner*—Werner H. Schroeder
*Assistant Examiner*—Bradley Kurtz DeSandro
*Attorney, Agent, or Firm*—Richard C. Stewart, II; Gerhard H. Fuchs

[57] ABSTRACT

An improved moving cavity yarn texturing device is described. One improved feature is a two stage energy tube which provides for more effective filling of the moving cavity by the yarn. The first stage has a cross section with a major axis an a minor axis. The second stage has a cross section with a major axis and a minor axis whose ratio is less than that of the first stage. A second feature is an improved chamber design which employs a channel having a "V" shaped cross section which eliminates snagging of the yarn by the cavity.

8 Claims, 2 Drawing Sheets

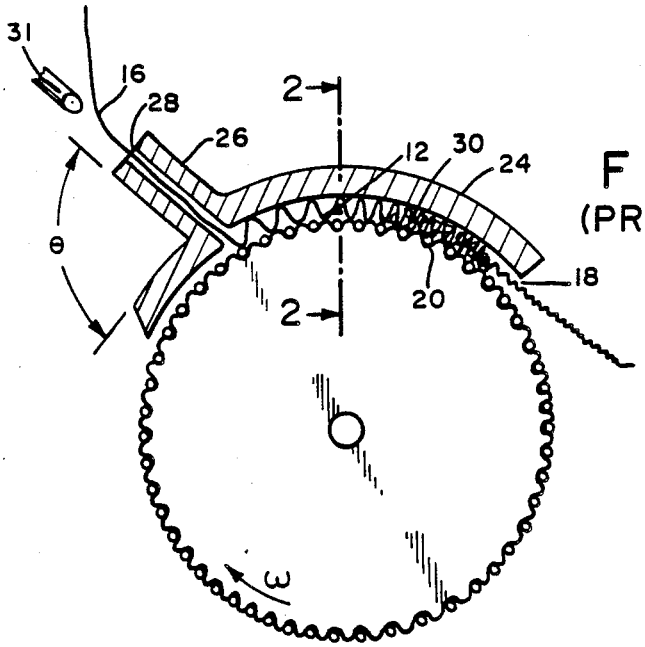
FIG. 1
(PRIOR ART)
FIG. 2
(PRIOR ART)
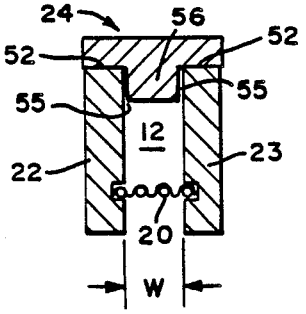
FIG. 3
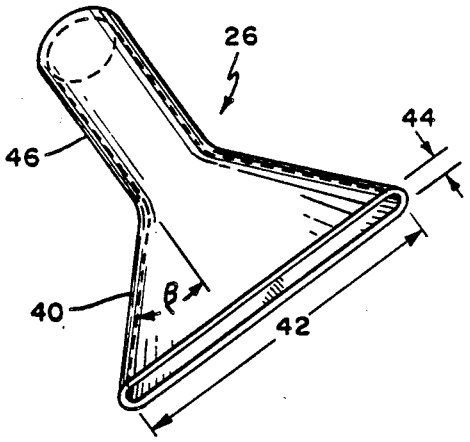

APPARATUS FOR TEXTURING CONTINUOUS YARN

This application is a division of U.S. patent application Ser. No. 594,958, filed Apr. 2, 1984, now U.S. Pat. No. 4,765,042 granted Aug. 23, 1988, which application is a continuation of U.S. patent application Ser. No. 357,499 filed Mar. 12, 1982, now abandoned.

FIELD OF THE INVENTION

This invention relates to an improved apparatus for preparing textured yarn, and more particularly to an apparatus for crimping textile fibrous materials such as, synthetic filament, yarn, tow, staple fibers and the like.

BACKGROUND ART

U.S. Pat. No. 4,074,405 discloses and claims an apparatus for crimping fibrous textile material in a chamber, the apparatus employs a continuous moving surface which act as the filament-receiving means, and serves to advance the crimped fibrous textile material. This moving surface provides a uniform residence time for the fibrous material in the chamber, improves the uniformity of crimp, and reduces streaks in fabric produced from the crimped fibrous material. The apparatus employs an energy tube to direct the fibrous material onto a filament-receiving means with velocity sufficient to crimp the fibrous material. The velocity of the moving surface is adjustable and maintained such that a filament is forced against a mass, or plug of filaments, and emerges from the chamber crimped.

SUMMARY OF INVENTION

The present invention is an improved apparatus for crimping a filament or a yarn. The improvements are useable for apparatus having a chamber, a perforated filament-receiving means at least partially disposed in chamber, and an energy tube in close proximity to the perforated filament-receiving means. It has been found that a more uniform crimping is obtained by employing a two stage energy tube which more effectively distributes the filaments in the chamber, and increases the uniformity of the crimping. The first stage of the energy tube is separated from the perforated filament-receiving means, but is in close proximity to the filament-receiving means. The first stage has a cross section with a major axis and a minor axis. The second stage of the energy tube is attached to the first stage The cross section of the second stage has a major axis and a minor axis, the ratio of which is less than the ratio of the major and minor axis of the first stage.

Preferably, the chamber of the improved apparatus has a tapered cross section. The cross section is bounded by two spaced apart sidewalls attached to the perforated filament-receiving means. The perforated filament-receiving means forms a third wall of the chamber. The spaced apart sidewalls diverge as they move away from the perforated filament-receiving means. A shoe, having a tongue which mates with the spaced apart sidewalls, offers the remaining constraint on the cross section of the chamber.

BRIEF DESCRIPTION OF THE DRAWINGS

FIG. 1 is an illustration of a prior art apparatus for texturing filament.

FIG. 2 is a section of the apparatus shown in FIG. 1 taken along the line 2—2.

FIG. 3 is a schematic representation of the improved two stage energy tube of the present invention that can be employed with prior art apparatus for texturing filaments, such as the apparatus shown in FIG. 1.

BEST MODES OF CARRYING THE INVENTION INTO PRACTICE

Figure 4:
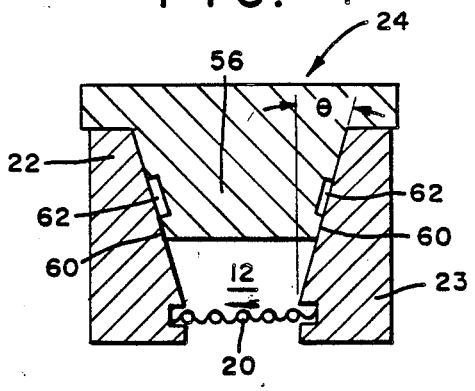
FIG. 4 is a schematic representation of the improved chamber design of the present invention which reduces filament snagging.

FIG. 1 is a schematic representaion of the prior art single chamber moving cavity texturing device described in U.S. Pat. No. 4,074,405. The device has a chamber 12, including an inlet opening 14 for receiving a filament or a yarn 16 to be crimped, and an outlet 18 for withdrawl of the filament or the yarn 16 therefrom after the filament or yarn 16 has been crimped on a screen which serves as a moving perforated filament-receiving means 20. FIG. 2 shows the section 2—2 of FIG. 1. The perforated filament-receiving means 20 is held in place by two spaced apart sidewalls 22, 23. The sidewalls 22, 23, and the perforated filament-receiving means 20 define three sides of the chamber The chamber 12 is completed by a shoe 24. The filament or yarn 16 is fed through an energy tube 26 by a heated compressed fluid, such as steam or air, which enters the chamber through the opening 28 The advancing heated compressed fluid brings the filament or yarn 16 into contact with the perforated filament-receiving means 20 which deflects and sets a crimp in the filament or yarn 16. The crimped yarn 16 is advanced in the chamber 12 by the moving perforated filament-receiving means 20 and by residual fluid pressure. Secondary crimps are introduced as the yarn advances into the chamber 12 forming a plug 30. The crimped yarn is withdrawn from the plug 30 through the outlet 18 of the chamber 12.

In order to effect texturing, the filament or yarn 16 is heated to an elevated temperature by the heated compressed fluid which is directed into the energy tube 26 by a nozzle 31 It has been found that the texturing is most effective when the filament or yarn 16 is uniformly spread across the width W of the perforated filament-receiving means 20. To minimize the volume of hot fluid required to heat the filament or yarn 16, the energy tube 26 has a small a cross section as possible consistent with accommodating the filament or yarn 16. On the other hand, to achieve uniform spreading of the filament or yarn 16 across the width W of the chamber, the energy tube 26 should have a cross section which is equal or smaller than the cross secton of the chamber 12.

It has been found that a substantial increase in the uniformity of the textured filaments can be obtained by incorporating a two stage energy tube as illustrated in FIG. 3. The first stage 40 of the energy tube 26 has a monotonically increasing major axis 42 with an angle of divergence $\beta$, and a monotonically decreasing minor axis 44. The major axis 42 should be its maximum, and preferably be at least 1.5 times the length of the minor axis 44, at the extremity of the first stage 40 which is closest to the perforated filament-receiving means 20. Furthermore, the angle of divergence, $\beta$ preferably should not be greater than about 10°. This limitation on $\beta$ will prevent turbulent flow of the fluid in the first stage 40. The major axis 42 at the extremity preferably is approximately equal to the width W of the perforated filament-receiving means 20. It is further preferred that the first stage 40 have a cross section which is ellipitical.

The second stage 46 of the energy tube 26 has a cross section in which the major axis is not more than 50% greater than the minor axis. It is preferred that the second stage 46 have a circular cross section.

The improved nozzle design of the present invention has allowed the use of larger chambers than were heretofore possible.

It has also been found, when the filament or the yarn 16 being textured is fine, the prior art chamber, with a cross section such as illustrated in FIG. 2, tends to snag the filament In FIG. 2, the shoe 24 rides on the top surface 52 of the sidewalls 22, 23 of the cavity 12. It is difficult to obtain a close clearance 55 between the sidewalls 22, 23 and the tongue 56 of the shoe 24. In general, this clearance 55 should be less than 0.001 inch (0.0025 cm) to prevent yarn snags. With a clearance as low as 0.0005 inch (0.00127 cm) the variation of the clearance may be as much as 0.000 inch to 0.002 inch (0.005 cm) when the cavity is heated and rotated The upper limit is unacceptable for fine filament material, since at this clearance the filaments would snag.

It has been found that the problem of snagging can be eliminated by employing a "V" shaped chamber 12, rather than a rectangular chamber such as described in U.S. Pat. No. 4,074,405.

FIG. 4 illustrates one embodiment of the "V" shaped chamber 12. The spaced apart sidewalls 22, 23 are attached to the perforated filament-receiving means 20. The sidewalls 22, 23 diverge as they move away from the perforated filament-receiving means 20. The shoe 24 has a tongue 56, the sides of the tongue mate with the sidewalls 22, 23 and minimize the clearance between the shoe 24 and the mating surfaces 60 of the sidewalls 22, 23. These mating surfaces 60 with respect to the tongue 56 will be self seating, and thereby avoid the excessive clearance of the prior art design.

Preferably, the surface area of the mating surfaces 60 is reduced by providing channels 62 in the tongue 56 as shown in FIG. 4, or alternatively providing a channel in the sidewalls 22, 23.

The inclination, or half angle of divergence $\theta$, and, of the sidewalls 22, 23 should be between about 10° and 80° (equal to an obtuse angle, as measured between the transverse axis of the perforated filament-receiving means and the interior surfaces of the side walls, of between about 100° and about 170°). If the angle $\theta$ is too small the size of the chamber 12 will vary excessively as wear occurs between the mating surfaces 60 formed by the tongue 56 and the sidewalls 22, 23. If the angle becomes too large then the tongue 56 will tend to "ride up" the sidewalls 22, 23. It is optimum to have an angle $\theta$ of about 30°.

Figure 5:
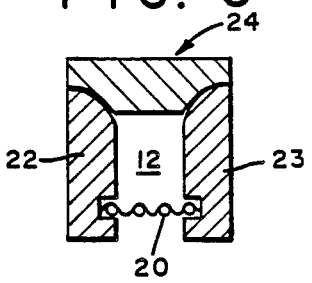
FIG. 5 is a schematic representation of a second embodiment of an improved chamber design of the present invention.

FIG. 5 illustrates a second sidewall design of the present invention where the sidewalls 22, 23 have curved divergent surfaces.

Figure 6:
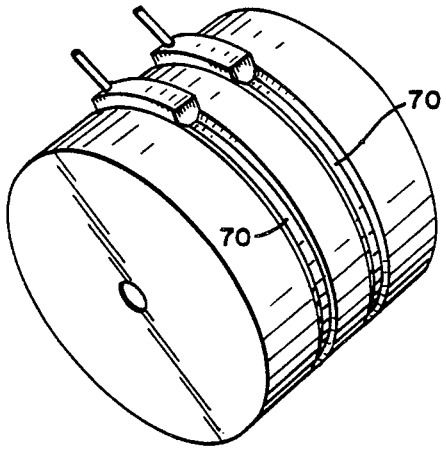
FIG. 6 illustrates one embodiment of a multiple chamber apparatus for crimping filaments employing the improved chamber design shown in FIG. 4.

FIG. 6 shows one embodiment of the present invention where multiple chambers 70 are employed. The chambers 70 have the design of the present invention. When multiple chambers are employed, it is of greatest importance that the filaments not snag since the breakage of one yarn will require shut down of the system.

EXAMPLE I

A yarn (150 denier/34 filaments) of polyethylene terephthalate, having n average molecular weight of 25,000, was textured using the apparatus shown in FIG. 1 with the improved energy tube of FIG. 3. The yarn was preheated in a preheater (not shown) to about 120° C. The yarn was fed into the energy tube 26 where it was aspirated by steam. The energy tube had a second stage 46 which was circular having a 1.56 mm diameter. The first stage 40 had an ellipitical cross section at the extremity of the energy tube nearest the perforated filament-receiving means 20. It had a minor axis of about 1 mm, and a major axis of 3.56 mm. The chamber 12 had a width of 5.08 mm and a depth of 1 mm. A nozzle 31 having 1.00 mm diameter was employed to inject steam into the energy tube 26. Supersatuated steam at 235° C. and 1206 kPa was supplied to the nozzle 31.

The yarn impacted a moving perforated filament-receiving means 20 at an angle of about 60°. The stream aspirated the yarn to about 2370 mpm. The perforated filament-receiving means 20 was a 90 mesh plain weave screen with 47% open area.

The texturing step increased the denier to 173, and produced a yarn with a tensile strength of 3.1 gpd. The resulting plug packing density was 41%, and the textured yarn had a skein shrinkage of 42%.

Knitted and dyed material showed excellent texturing and uniformity.

EXAMPLE II

Example I was repeated with the exception that a prior art single diameter energy tube was used. The tube had a diameter of 3.81 mm, which gave the energy tube a larger cross sectional area than the cross sectional area of the chamber. This ratio of areas is as suggested in the preferred embodiment of U.S. Pat. No. 4,074,405.

The resulting plug 30 showed non-uniform packing of the chamber 12, especially near the corners. The resulting yarn texture level was lower than the texture level of the yarn of Example I.

What we claim is:

1. A process for texturing yarn comprising the steps of:

(a) drawing a continuous tow of filaments through an energy tube by flowing heated fluid through the energy tube to aspirate the filaments, the energy tube having an upstream end where filaments enter the energy tube, a downstream end where filaments are aspirated from the tube and a longitudinal axis extending from the upstream end to the downstream end, and comprising a first stage, including the downstream end, having a cross section, normal to the longitudinal axis, with a major axis and a minor axis perpendicular thereto, the first stage having a first dimension along the major axis which is greatest at the downstream end and a second dimension along the minor axis which is smallest at the downstream end and, a second stage connected to the first stage and including the upstream end, the second stage having a cross section, normal to the longitudinal axis, with a major axis and a minor axis perpendicular thereto, the second stage having a first dimension along the major axis of the second stage and a second dimension measured along the minor axis of the second stage, the first to second dimension ratio of the first stage being greater at the downstream end than the first to second dimension ratio of the second stage, the first dimension of the first stage decreasing monotonically toward the downstream end and interior surfaces of the first stage delimiting the first dimension of the first stage diverging at an angle from the longitudinal axis less than about 10°; and (b) continuously feeding the heated aspirated tow of filaments uniformly over substantially the entire surface area of a perforated filament-receiving surface to produce a finely textured tow of filaments.

2. An apparatus for crimping a continuous tow of filaments comprising means defining a chamber, said means defining the chamber including a perforated longitudinally and transversely extending filament-receiving means, and an energy tube extending into the chamber having a transverse axis parallel to a transverse axis of the filament-receiving means and a longitudinal axis which is normal to the chamber transverse axis, said energy tube extending from an upstream end where filaments enter the energy tube to a downstream end in close proximity to said filament-receiving means; the improvement wherein the energy tube comprises:

a first stage adjacent the downstream end, the first stage having a cross section with respect to the longitudinal axis with a major axis parallel to the chamber transverse axis and a minor axis normal to the major axis, said first stage having a first dimension along the major axis which is greatest adjacent the downstream end and a second dimension along the minor axis which is smallest adjacent said downstream end, internal surfaces of walls delimiting the first dimension diverging monotonically toward said downstream end less than 10°, while said second dimension decreases monotonically toward said downstream end; and a second stage connected to the first stage, said second stage having a cross section with respect to the longitudinal axis with a major axis parallel to the chamber transverse axis and a minor axis normal to the chamber transverse axis, the second stage having a transverse dimension along the major axis and a normal dimension along the minor axis, with the first to second dimension ratio being greater than the transverse to normal dimension ratio.

3. An apparatus as in claim 2 wherein the diverging chamber-defining surfaces are substantially planar diverging surfaces.

4. An apparatus as in claim 2 wherein the diverging chamber-defining surfaces are curved diverging surfaces.

5. An apparatus as in claim 2 wherein the obtuse angle is about 120.

6. An apparatus as in claim 2 wherein multiple chambers are arranged to simultaneously process filaments fed to the chambers, each chamber having an individual energy tube associated therewith.

7. An apparatus as in claim 2 wherein the cross section of the first stage varies between elliptical at the downstream end to substantially circular at an end adjacent to the second stage and wherein the cross section of the second stage is substantially circular.

8. A process according to claim 1 wherein the cross-section of the first stage varies between elliptical at the downstream end to substantially circular at an end adjacent to the second stage and wherein the cross-section of the second stage is substantially circular.

* * * * *